US007009485B2

(12) United States Patent
Tomohiro et al.

(10) Patent No.: US 7,009,485 B2
(45) Date of Patent: Mar. 7, 2006

(54) LAMINATE-TYPE CERAMIC ELECTRONIC COMPONENT

(75) Inventors: Takashi Tomohiro, Omihachiman (JP); Hiromichi Tokuda, Takefu (JP); Yoshihiro Imanishi, Sagamihara (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/988,364

(22) Filed: Nov. 12, 2004

(65) Prior Publication Data

US 2005/0128042 A1 Jun. 16, 2005

(30) Foreign Application Priority Data

Dec. 12, 2003 (JP) ..... 2003-415324

(51) Int. Cl.
*H01F 5/00* (2006.01)

(52) U.S. Cl. ..... 336/200

(58) Field of Classification Search ..... 336/65, 336/83, 200, 206–208, 222–223, 232
See application file for complete search history.

(56) References Cited

U.S. PATENT DOCUMENTS 6,597,270 B1 * 7/2003 Takashima et al. ..... 336/83
6,630,881 B1 * 10/2003 Takeuchi et al. ..... 336/200

FOREIGN PATENT DOCUMENTS

JP 2002-373809 12/2002

* cited by examiner

*Primary Examiner*—Tuyen T Nguyen
(74) *Attorney, Agent, or Firm*—Keating & Bennett, LLP

(57) ABSTRACT

A laminate-type electronic component includes has a first coil and a second coil, and the number of turns of the first coil is smaller than that of the second coil due to a positional relationship between input-output electrodes. As a result, the thickness of an outer layer on the first coil side is increased, that is, the magnetic path cross-sectional area of the outer layer is increased. Thus, the inductance of the first coil is decreased. The thickness of the outer layer on the second coil side is decreased, that is, the magnetic path cross-sectional area of the outer layer on the second coil side is decreased. Thus, the inductance of the second coil is decreased.

11 Claims, 7 Drawing Sheets

LAMINATE-TYPE CERAMIC ELECTRONIC COMPONENT

BACKGROUND OF THE INVENTION

1. Field of the Invention

The present invention relates to a laminate-type ceramic electronic component, and in particular, to a laminate-type ceramic electronic component in which plural coils are magnetically-coupled to each other, such as a laminate-type common mode choke coil, a laminate-type transducer or other suitable component.

2. Description of the Related Art

Common mode choke coils have a structure in which the magnetic fields of two coils intensify each other to produce a magnetic material loss when common mode noise is applied. On the other hand, when a normal mode signal is applied, the magnetic fields of the two coils are cancelled out by each other so that no magnetic material loss is generated. In particular, when inductances generated by the two coils are equal, the magnetic field is minimal, and a minimum magnetic loss is generated for an applied normal mode signal. Thus, the common mode choke coils are designed so that the inductances of the two coils are equal.

According to a known common mode choke coil such as a laminate-type common mode choke coil described in Japanese Unexamined Patent Application Publication No. 2002-373809, two coils are arranged in the lamination direction of ceramic layers while the axial directions of the two coils substantially are set so as to coincide with the lamination direction of the ceramic layers. As shown in FIG. 7, a common mode choke coil 110 as described above includes ceramic sheets 132 having coil conductors 111 to 114 and 115 to 118, and via-holes 126 used for connection between layers, an interlayer ceramic sheet 133 having no conductor formed thereon, outer layer ceramic sheets 134, and so forth.

The coil conductors 111 to 114 are electrically connected in series through the interlayer connection via-holes 126 formed in the ceramic sheets 132 to form a spiral coil La. The coil conductors 115 to 118 are electrically connected in series through the interlayer connection via-holes 126 formed in the ceramic sheets 132 to form a spiral coil Lb.

The ceramic sheets 132 are laminated and integrally fired to form a laminate. Input-output external electrodes are formed on the surface of the laminate.

In the common mode choke coil 110, in some cases, the numbers of turns of the two spiral coils La and Lb can not be set to be equal, depending on the positions of their input-output external electrodes. The numbers of turns of the spiral coils La and Lb are compared below. The number of turns of the spiral coil Lb is larger than that of the spiral coil La by the sum of the lengths shown by surrounding ellipses A1 and A2 (total of about 0.5 turn) in FIG. 7, irrespective of the number of laminated ceramic sheets.

If the numbers of turns of the two spiral coils La and Lb are different, the difference between the numbers of turns will cause the difference between the inductances generated by the coils La and Lb (impedances). When the inductances (impedances) of the two coils La and Lb provided in the common mode choke coil 110 are unbalanced, a large inductance (impedance) is generated, and a dielectric material loss is generated for a normal mode signal applied.

According to the known common mode choke coil 110, the difference between the inductances of the two spiral coils La and Lb is adjusted by partially changing the sizes of the spiral coils La and Lb, the widths of the coil conductors 111 to 114 and 115 to 118, or the like.

However, in the case where the patterns of the coil conductors 111 to 114 and 115 to 118 are changed, the number of the types of patterns for the coil conductors 111 to 114 and 115 to 118 increases. It is difficult to manage the formation of such a large number of patterns. Moreover, to adjust the inductances in the above-described manner, it is necessary to prepare several types of patterns for trial and error adjustment.

If the patterns are changed, a change will be caused in a magnetic flux, depending on the types of the changed patterns. Thus, the magnetic coupling between the spiral coils La and Lb is undesirably deteriorated. That is, a dangerously low inductance will be generated when common mode noise is applied, and a large inductance will be generated for a normal mode signal applied.

SUMMARY OF THE INVENTION

In order to overcome the problems described above, preferred embodiments of the present invention provide a laminate-type ceramic electronic component in which the inductances of at least two coils can be adjusted while the patterns of coil conductors and the numbers of turns of the coils are not changed, and the inductances of the at least two coils can be adjusted to be equal while the shape and size of the patterns of the coil conductors is not changed when the numbers of turns of the coils are different from each other.

According to a first preferred embodiment of the present invention, a laminate-type ceramic electronic component includes a laminate including a plurality of ceramic layers and a plurality of coil conductors that are laminated to each other, and first and second coils including the plurality of coil conductors, the first and second coils being arranged in the lamination direction of the ceramic layers while the axial directions of the first and second coils are substantially coincident with the lamination direction of the ceramic layers, the distance T1 between the first coil and the surface of the outer layer of the laminate nearer to the first coil and the distance T2 between the second coil and the surface of the outer layer of the laminate nearer to the second coil in the lamination direction being different from each other. Preferably the size of the first coil and the size of the second coil are substantially equal to each other.

In the laminate-type ceramic electronic component, the outer layer nearer to the first coil defines a magnetic path for a magnetic flux generated mainly by the first coil, and the outer layer nearer to the second coil defines a magnetic path for a magnetic flux generated mainly by the second coil. Thus, the cross-sectional area of the outer layer defining the magnetic path for a flux generated by the first coil, and the cross-sectional area of the outer layer defining the magnetic path for a flux generated by the second coil can be adjusted by setting the distances T1 and T2 so as to be different from each other. In particular, when the distance T1 or T2 is reduced, and thereby, the cross-sectional areas of the outer layer decrease, the inductance of the coil decreases. When the distance T1 or T2 is increased, and thereby, the cross-sectional areas of the outer layer decrease, the inductance of the coil increases.

Therefore, even if the number of turns of the first coil and the number of turns of the second coil are different from each other, the inductances of the first and second coils can be made equal by reducing the cross-sectional area of the outer layer with the relatively small number of turns, and increasing the cross-sectional area of the outer layer with the relatively large number of turns.

According to a second preferred of the present invention, a laminate-type ceramic electronic component includes a laminate including a plurality of ceramic layers and a plurality of coil conductors that are laminated to each other, and first, second, and third coils including the plurality of coil conductors; the first, second, and third coils being arranged in that order in the lamination direction of the ceramic layers while that axial directions of the first, second, and third coils are substantially coincident with the lamination direction of the ceramic layers, at least one of the first, second, and third coils having the number of turns different from the number of turns of each of the other coils, the distance T1 between the first coil and the surface of the outer layer of the laminate nearer to the first coil, the distance T2 between the second coil and the surface of the outer layer of the laminate nearer to the second coil in the lamination direction, the distance D1 between the first and second coils, and the distance D2 between the second and third coils being set so that the inductances of the first, second, and third coils are substantially equal to each other. Thus, the laminate-type ceramic electronic component of a tri-filar winding type, provided with three coils, is produced.

According to various preferred embodiments of the present invention, the inductances of the coils can be adjusted by setting the distances between the respective coils and the surfaces of the outer layers to be different from each other without the shape and size of the patterns of the coil conductors and the numbers of turns of the coils being changed. Moreover, when the numbers of turns of the coils are different from each other, the inductances of the coils can be adjusted so as to be equal each other by setting the distances between the respective coils and the surfaces of the outer layers to be different from each other without the shape and size of the patterns of the coil conductors being changed.

Other features, elements, characteristics and advantages of the present invention will become more apparent from the following detailed description of preferred embodiments of the present invention with reference to the attached drawings.

DETAILED DESCRIPTION OF PREFERRED EMBODIMENTS

Hereinafter, a laminate-type ceramic electronic component according to preferred embodiments of the present invention will be described with reference to the accompanying drawings.

First Preferred Embodiment

Figure 1:
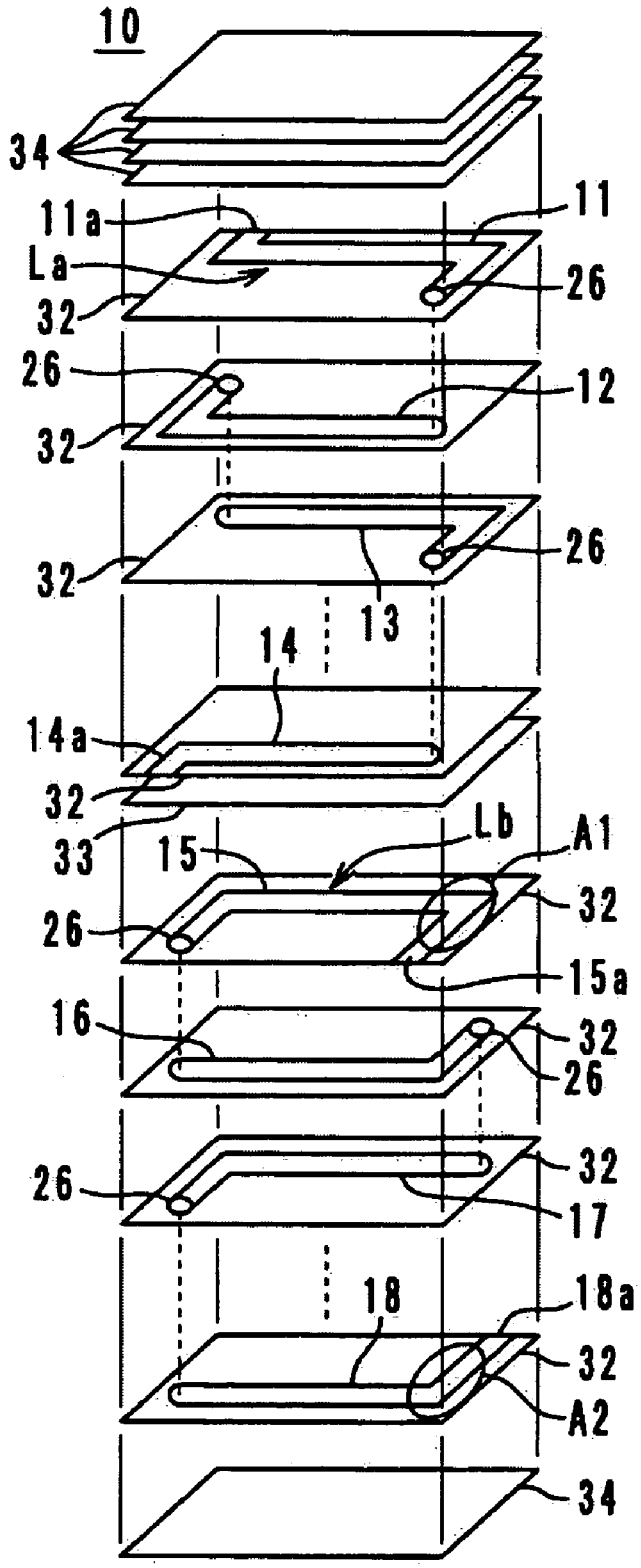
FIG. 1 is an exploded perspective view of a laminate-type ceramic electronic component according to a first preferred embodiment of the present invention.

As seen in FIG. 1, a bi-filar type, laminate-type common mode choke coil 10 includes ceramic sheets 32 having coil conductors 11 to 14 and 15 to 18, and via-holes 26 used for connection between layers, an interlayer ceramic sheet 33 having no conductor formed thereon, outer layer ceramic sheets 34, and so forth.

The ceramic sheets 32 are preferably made of a magnetic ceramic material. For example, the ceramic sheets 32 are preferably produced by mixing a binder such as Fe—Ni—Cu type ferrite powder with a binder and so forth, and forming the mixture into a sheet by a doctor blade method or other suitable process.

The coil conductors 11 to 14 and 15 to 18 are formed on the ceramic sheets 32 by a screen printing method, a photolithographic method, or other suitable process. The coil conductors 11 to 14 and 15 to 18 are made of Ag, Pd, Cu, Au, their alloys, or other suitable process.

The interlayer connection via-holes 26 are formed by forming via-holes in the sheets 32 by use of a laser beam or the like before the coil conductors 11 to 13 and 15 to 17 are formed, and filling conductive paste containing Ag Pd, Cu, Au, their alloys, or the like into the via-holes by a print-coating method or other suitable process.

The coil conductors 11 to 14 are electrically connected in series through the interlayer connection via-holes 26 formed in the ceramic sheets 32 to form a spiral coil La having a clockwise turn-direction. One of the ends of the coil La (i.e., a lead-out portion 11*a* of the coil conductor 11) is exposed onto a left portion of the side of the ceramic sheet 32 positioned on the back side thereof as viewed in FIG. 1. The other end (i.e., a lead-out portion 14*a* of the coil conductors 14) is exposed onto a right portion of the side the ceramic sheet 32 on the front side thereof as viewed in FIG. 1.

The coil conductors 15 to 18 are electrically connected in series through the interlayer connection via-holes 26 formed in the ceramic sheets 32 to form a spiral coil Lb having a counterclockwise turn-direction. One of the ends of the coil Lb (i.e., a lead-out portion 15*a* of the coil conductor 15) is exposed onto a right portion of the side of the ceramic sheet 32 positioned on the front side thereof as viewed in FIG. 1. The other end (i.e., a lead-out portion 18*a* of the coil conductors 18) is exposed onto a right portion of the side of the ceramic sheet 32 on the back side thereof as viewed in FIG. 1.

Then, the numbers of turns of the spiral coils La and Lb are compared. The number of turns of the spiral coil Lb is larger than that of the spiral coil La by the sum of the lengths shown by surrounding ellipses A1 and A2 (total of about 0.5 turn), as shown in FIG. 1. That is, the number of turns of the two spiral coils La, Lb can not be set to be equal due to the positional relationship between the input-output electrodes 1*a* to 2*b* thereof. Common mode choke coils are designed in such a manner that the spiral coils have the possible smallest difference between the numbers of turns. Thus, generally, the difference between the numbers of turns is about 0.5 turn. However, the difference between the numbers of turns depends on the arrangement of their input-output external electrodes and lead-out electrodes. Thus, the difference is preferably set to be in the range of not less than 0 to not more than about 1.0.

Figure 2:
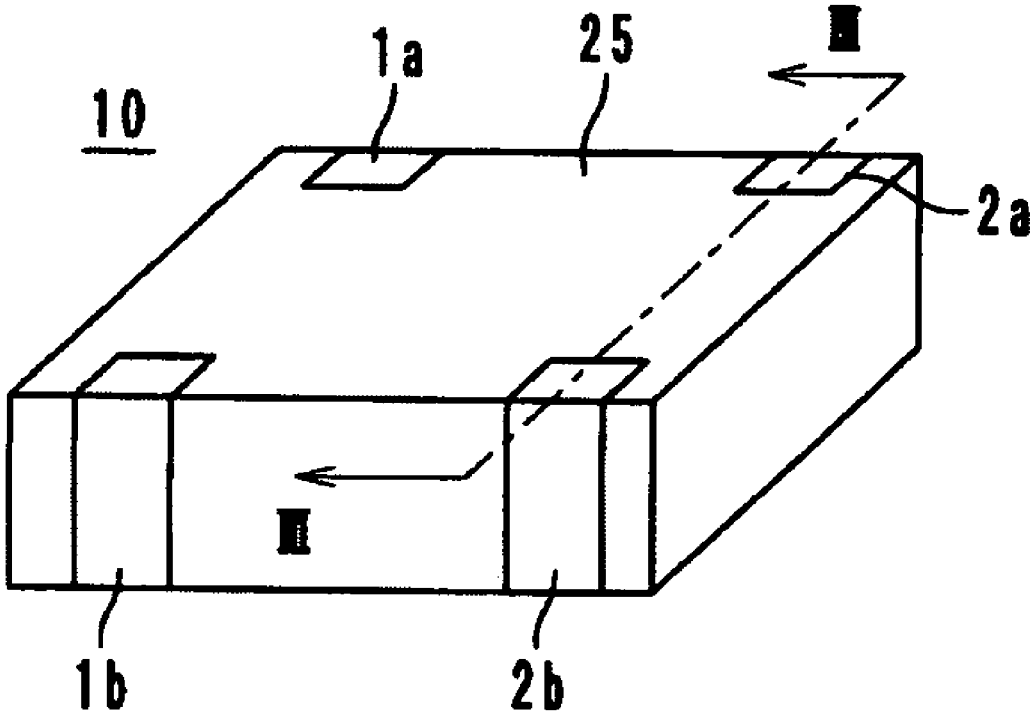
FIG. 2 is a perspective view showing the appearance of the laminate-type ceramic electronic component of FIG. 1.

The ceramic sheets 32 having the above-described configuration are stacked, as shown in FIG. 1, press-bonded, and integrally fired. Thus, a laminate 25 having a substantially rectangular shape as shown FIG. 2 is produced. Input electrodes 1*a* and 2*a* are formed on right and left portions of the back side surface of the laminate 25, as viewed in FIG. 2. Output electrodes 1*b* and 2*b* are formed on right and left portions of the front side surface of the laminate 25.

The input electrode 1*a* and the output electrode 1*b* are electrically connected to both ends of the coil La, specifically, to a lead-out portion 11*a* of the coil conductor 11 and a lead-out portion 14*a* of the coil conductor 14. The input electrode 2*a* and the output electrode 2*b* are electrically connected to both ends of the coil Lb, specifically, to a lead-out portion 18*a* of the coil conductor 18 and a lead-out portion 15*a* of the coil conductor 15. These input-output electrodes 1*a* to 2*b* are preferably formed by coating-baking, dry plating, or other suitable process.

Figure 3:
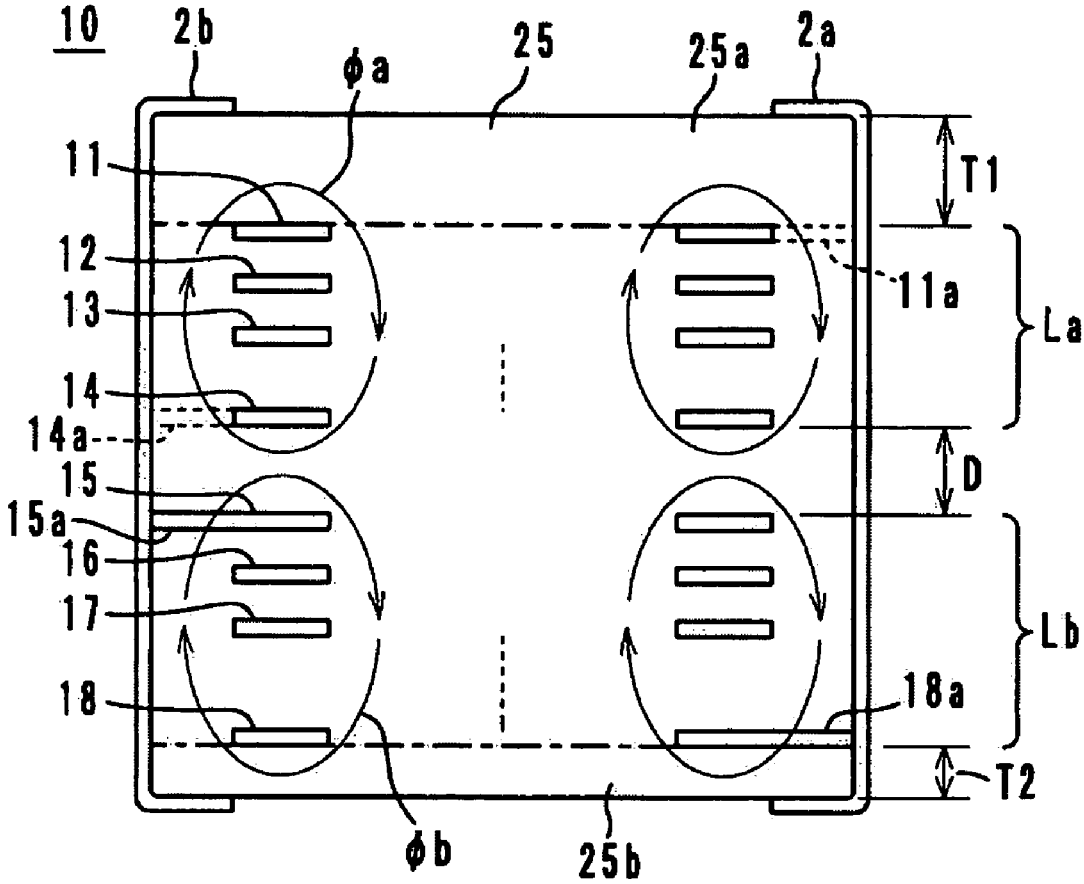
FIG. 3 is a schematic cross-sectional view of the laminate-type ceramic electronic component taken along line III—III in FIG. 2.

FIG. 3 schematically shows the configuration of the laminate-type common mode choke coil 10. The coil La and the coil Lb are arranged in upper and lower positions in the stacking direction of the ceramic sheets 32, respectively. In particular, according to the first preferred embodiment, the coil axes of the coils La and Lb are arranged in a straight line, so that the magnetic coupling degree between the coils La and Lb becomes large.

The common mode choke coil 10 having the above-described configuration has a relatively high normal mode impedance, and is effective in eliminating both of the normal mode noise and the common mode noise. Thus, the common mode choke coil 10 is preferably incorporated in a sound signal line of which the transmission signal rate is relatively small, or is incorporated in some other similar application and device.

Regarding to the laminate-type common mode choke coil 10, the distance T1 between the spiral coil La and the surface of the outer layer relatively near to the coil La in the stacking direction of the ceramic sheets 32 is set so as to be different from the distance T2 between the spiral coil Lb and the surface of the outer layer relatively near to the coil Lb. In other words, the thickness of the outer layer 25*a* on the spiral coil La side and that of the outer layer 25*b* on the spiral coil Lb side are different from each other.

The outer layer 25*a* on the coil La side defines a magnetic path for a magnetic flux ϕa generated mainly by the coil La. The outer layer 25*b* on the coil Lb side defines a magnetic path for a magnetic flux ϕb generated mainly by the coil Lb. Therefore, the cross-sectional area of the outer layer 25*a* defining the magnetic path for the magnetic flux ϕa generated mainly by the coil La and the cross-sectional area of the outer layer 25*b* defining the magnetic path for the magnetic flux ϕb generated mainly by the coil Lb can be adjusted by changing the distances T1 and T2. That is, when the magnetic path cross-sectional areas of the outer layers 25*a* and 25 are decreased, the inductances of the coil La and the coil Lb are reduced. When the magnetic path cross-section areas of the outer layers 25*a* and 25 are increased, the inductances of the coil La and the coil Lb decrease.

As a result, the inductances of the coils La and Lb can be adjusted without the numbers of turns of the coils La and Lb and the patterns of the coil conductor 11 to 14 and 15 to 18 being changed. In particular, even if the coils La and Lb are set so as to have the numbers of turns different from each other, the inductances of the coils La and Lb can be made equal to each other by adjustment of the distances T1 and T2. Moreover, even if the numbers of turns are set so as to be equal to each other, the coils La and Lb having the same inductance can be produced.

In the case where the number of turns of the coil La is smaller than that of the coil Lb, caused by the positional relationship between the input-output electrodes 1*a* to 2*b* as in the first preferred embodiment, the thickness of the outer layer 25*a* on the side of the coil La with the relatively small number of turns is increased (in other words, the distance T1 is increased), so that the magnetic path cross-sectional area of the outer layer 25*a* increases. Thereby, the inductance of the coil La having the relatively small number of turns is increased. On the other hand, the thickness of the outer layer 25*b* on the side of the coil Lb having the relatively large number of turns is reduced (in other words, the distance T2 is reduced), so that the magnetic path cross-sectional area of the outer layer 25*b* decreases. Thereby, the inductance of the coil Lb with the relatively large number of turns is reduced.

In the case where the numbers of turns of the coils La and Lb are different from each other, the inductances of the coils La and Lb can be made equal to each other without the patterns of the coil conductors 11 to 14 and 15 to 18 being further changed or a new coil conductor being added. Thus, the inductance (impedance) of the common mode choke coil 10 with respect to a normal mode signal can be reduced. In particular, the common mode choke coil 10 is suitable for use in balanced transmission lines, which are required to have the same impedance.

Moreover, according to this preferred embodiment, the distribution-ratio of the thickness of the outer layer 25*a* and that the outer layer 25*b* is changed with the total thickness of the outer layer 25*a* and outer layer 25*b* being kept at a constant value (T1+T2=constant). Thus, the sizes of the component and the manufacturing cost are not substantially changed. Moreover, the magnetic coupling of the coil La to the coil Lb is prevented from being reduced, since the distance D between the adjacent coils La and Lb, and the coil conductor 11 to 14 and 15 to 18 are not changed.

Referring to a method of making equal the inductances of two coils with different numbers of turns, it may be proposed to change the sizes of the coils. However, if the sizes of the coils are changed, the coupling coefficient between the two coils will be reduced. On the other hand, according to the first preferred embodiment, the inductances of the coils La and Lb can be made equal while the coil sizes of the coils La and Lb are kept equal to each other. Therefore, the high coupling coefficient can be maintained.

To investigate a relationship between the ratio of the outer layer thicknesses (T1/T2) and the difference (Lb−La) between the inductances of the coils La and Lb, laminate-type common mode choke coils 10 having an approximate size of 1.2 mm (L)×1.0 mm (W)×0.5 mm (T) and having different thicknesses of the outer layers, as shown in Table 1, were produced for a trial and evaluated. The numbers of turns of the coils La and Lb were about 4.75 and about 5.25, respectively. The distance D between the coils La and Lb was constant.

TABLE 1

| Number of turns | | Thickness of outer layer (μm) | | | Inductance (μH) | | |
|---|---|---|---|---|---|---|---|
| Coil La | Coil Lb | T1 | T2 | T1/T2 | Coil La | Coil Lb | La − Lb |
| 4.75 | 5.25 | 134 | 134 | 1.00 | 1.568 | 1.884 | 0.316 |
| 4.75 | 5.25 | 184 | 84 | 2.19 | 1.622 | 1.705 | 0.084 |
| 4.75 | 5.25 | 194 | 74 | 2.62 | 1.623 | 1.646 | 0.023 |

Moreover, laminate-type common mode choke coils 10 of which the numbers of turns of the coils La and Lb were about 7.75 and about 8.25, respectively, and the distance D between the coils La and Lb was constant were produced for a trial and evaluated (see Table 2).

TABLE 2

| Number of turns | | Thickness of outer layer (μm) | | | Inductance (μH) | | |
|---|---|---|---|---|---|---|---|
| Coil La | Coil Lb | T1 | T2 | T1/T2 | Coil La | Coil Lb | La − Lb |
| 7.25 | 8.25 | 75 | 75 | 1.00 | 3.058 | 3.363 | 0.305 |
| 7.25 | 8.25 | 85 | 65 | 1.31 | 3.198 | 3.283 | 0.085 |
| 7.25 | 8.25 | 95 | 55 | 1.73 | 3.238 | 3.107 | −0.131 |

Figure 4:
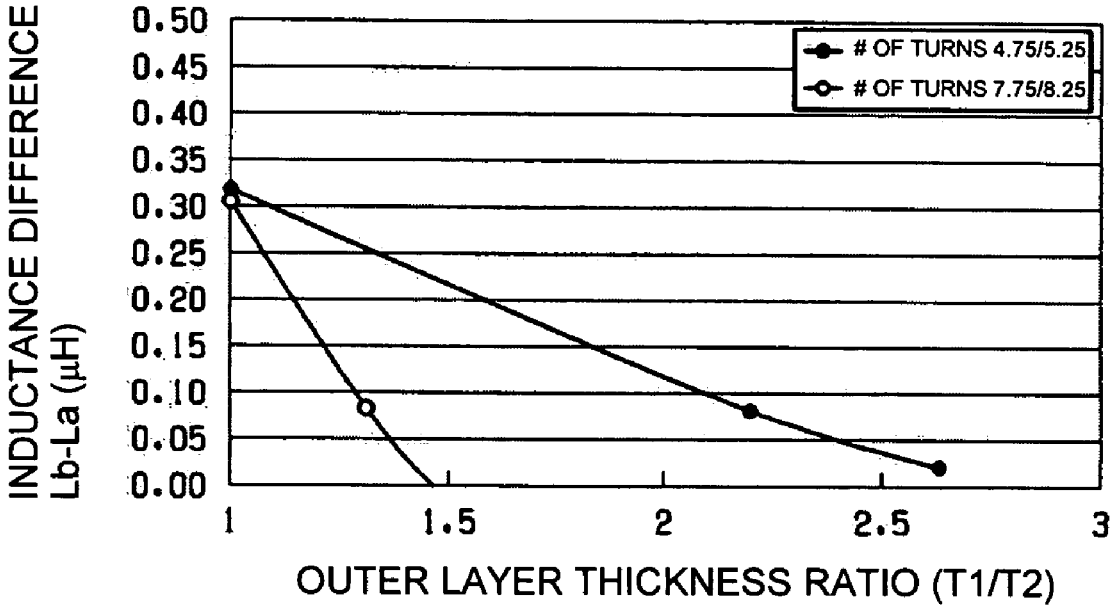
FIG. 4 is a graph showing a relationship between the ratios of the thicknesses of the outer layers and the inductance differences.
Figure 5:
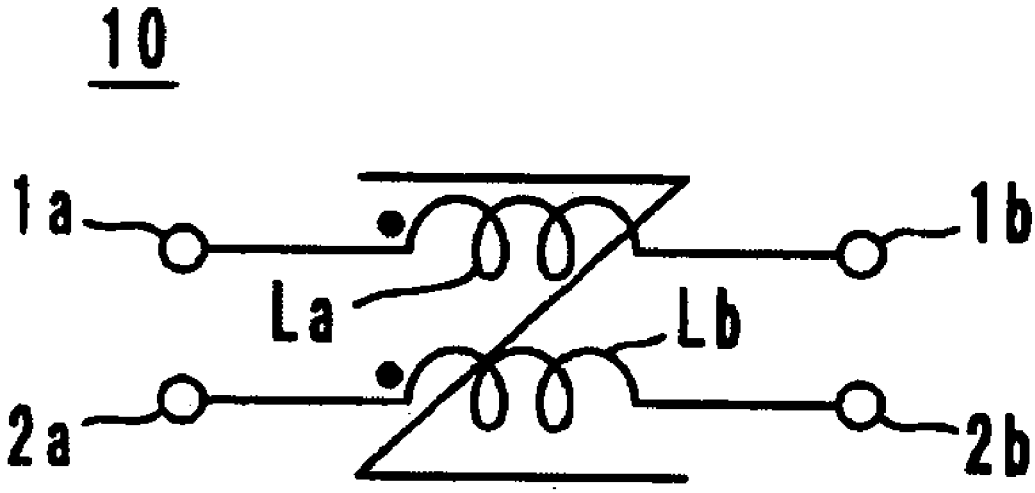
FIG. 5 is an electric equivalent circuit of the laminate-type ceramic electronic component shown in FIG. 2.

FIG. 4 is a graph showing the evaluation results listed in Tables 1 and 2. It is seen that the difference (Lb−La) between the inductances of the coil La and Lb becomes nearly zero when the thickness (distance T1) of the outer layer 25*a* on the side of the coil La having the relatively small number of turns is larger than the thickness (distance T2) of the outer layer 25*b* on the side of the coil Lb having the relatively large number of turns. FIG. 5 is an electric equivalent circuit diagram of the laminate-type common mode choke coil 10.

Second Preferred Embodiment

Figure 6:
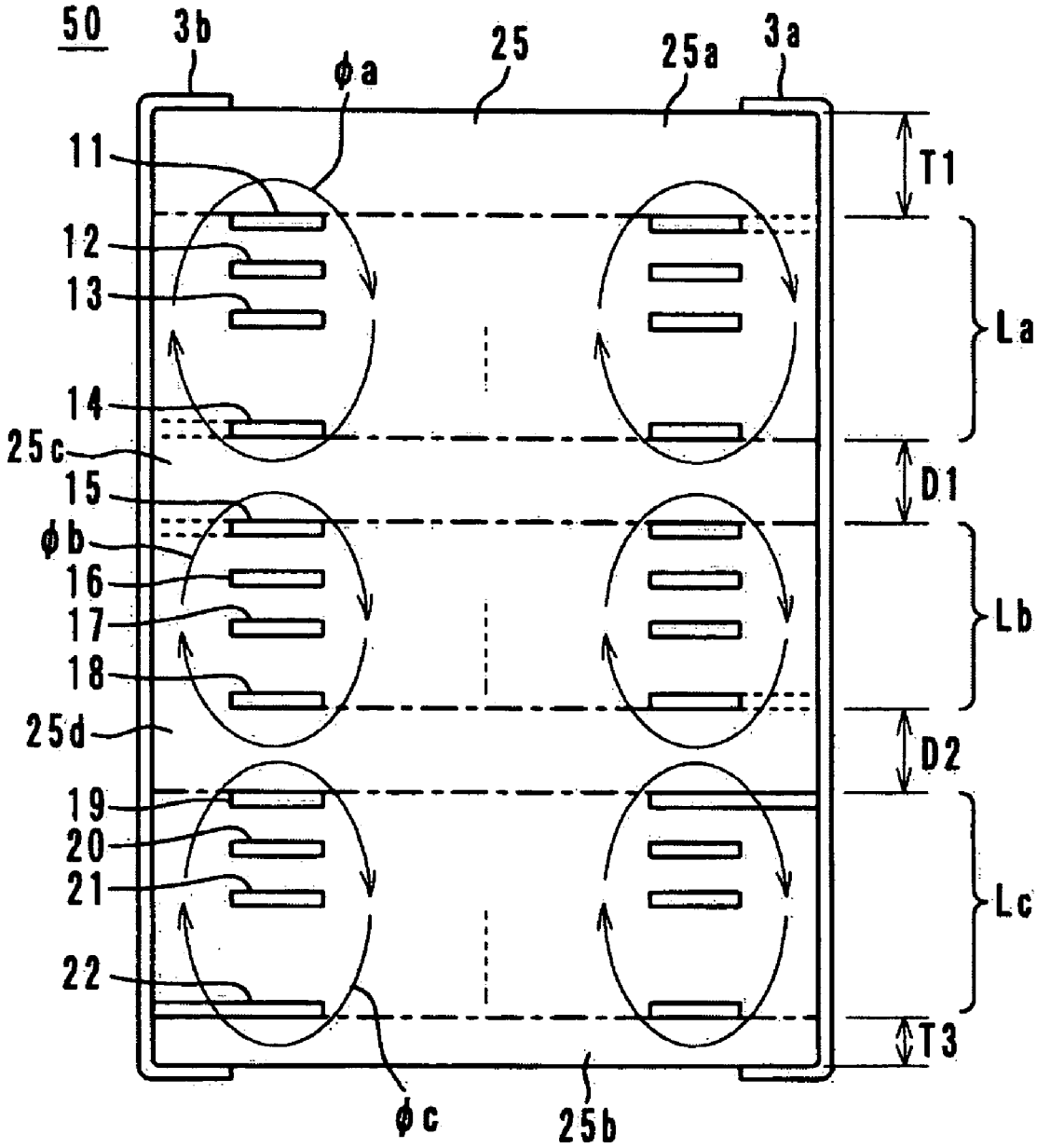
FIG. 6 is a schematic cross-sectional view of a laminate-type ceramic electronic component according to a second preferred embodiment of the present invention.
Figure 7:
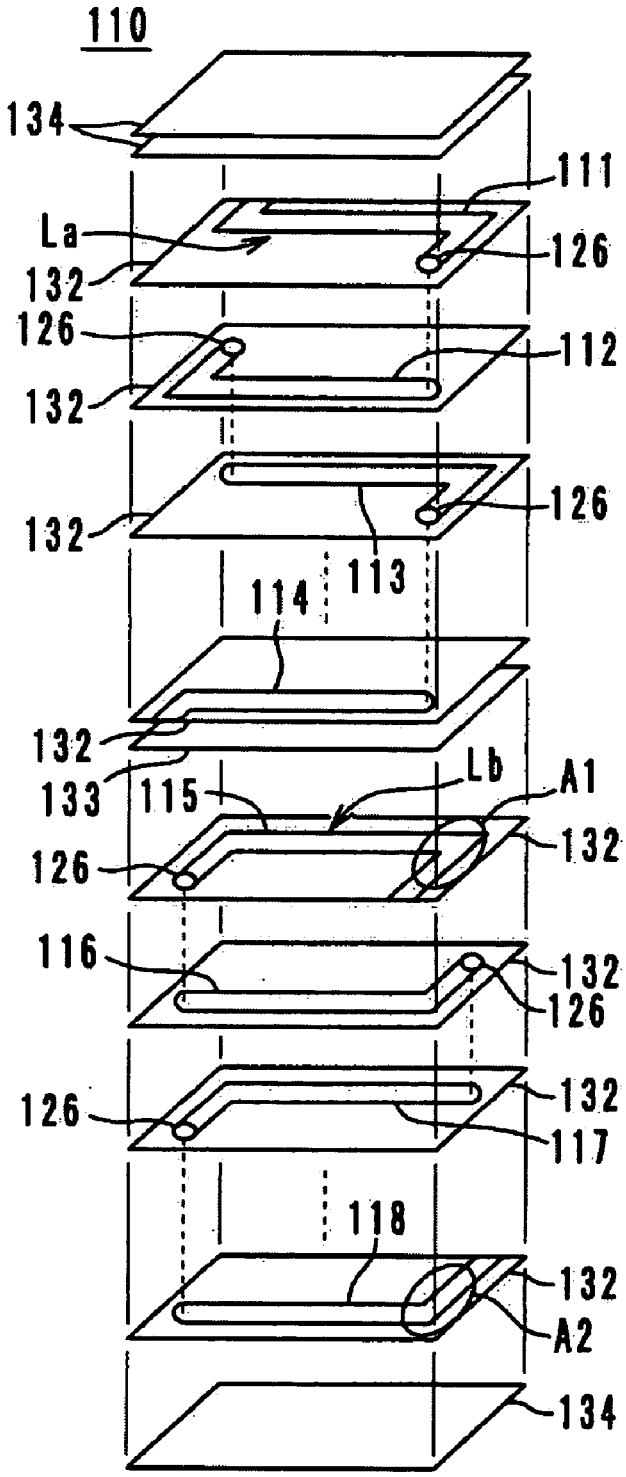
FIG. 7 PRIOR ART
FIG. 7 is an exploded perspective view of a known laminate-type ceramic electronic component.

In the second preferred embodiment, a laminate-type common mode choke coil of a tri-filar type provided with three coils is described. FIG. 6 shows a tri-filar type common mode choke coil 50 in which three spiral coils La, Lb, and Lc are arranged in the lamination direction of ceramic sheets.

The spiral coil Lc is preferably formed by electrically connecting coil conductors 19 to 22, formed on ceramic sheets, in series through via-holes for interlayer connection. The spiral coil Lc is connected between an input electrode 3*a* and an output electrode 3*b*. The outer layer 25*b* on the coil Lc side defines a magnetic path for a magnetic flux $\phi c$ generated mainly by the spiral coil Lc.

In general, the numbers of turns of the coils La, Lb, and Lc are different from each other due to a positional relationship between the input-output electrodes 1*a* to 3*b*. Thus, first, the numbers of turns of the coil La and Lc are compared to each other. Then, the thickness of the outer layer positioned nearer to the coil with the relatively large number of turns is reduced. On the other hand, the thickness of the outer layer nearer to the coil with the relatively small number of turns is increased. In the second preferred embodiment, for example, the number of turns of the coil La is set so as to be smaller than that of the coil Lc. Thus, the thickness (i.e., the distance T1) of the outer layer 25*a* on the side of the coil La with the relatively small number of turns is increased, so that the magnetic path cross-sectional area of the outer layer 25*a* increases. Therefore, the inductance of the coil La with the relatively small number of turns increases. On the other hand, the thickness (i.e., the distance T3) of the outer layer 25*b* on the side of the coil Lc with the relatively large number of turns is reduced, so that the magnetic path cross-sectional area of the outer layer 25*c* decreases. Therefore, the inductance of the coil Lc with the relatively large number of turns decreases. In this manner, the coils La and Lc are adjusted so as to have the same inductances.

Thereafter, the coils La, Lb, and Lc are adjusted such that the inductances of the coil Lb located in the middle between the coils La and Lc, becomes equal to the inductance of the respective coils La and Lb positioned on the outer sides. If the inductance of the coil Lb is smaller than that of the respective coils La and Lc, the positions of the coils La and Lc are nearer to the outer layers 25*a* and 25*b*, respectively (i.e., the distances T1 and T3 are reduced), so that the inductances of the coils La and Lc decrease. In this case, it is not necessary to make equal the thickness (distance D1) of an intermediate layer 25*c* between the coils La and Lb and that (distance D2) of an intermediate layer 25*d* between the coils Lb and Lc. However, from the standpoints of the coupling coefficient and the insulation property of the coils La, Lb, and Lc, it is disadvantageous that the distances D1 and D2 are increased to be larger than predetermined values.

If the inductance of the Lb is larger than the inductance of the respective coils La and Lc, the coils La and Lb are positioned nearer to the coil Lb (the distances T1 and T3 are increased), so that the inductances of the coils La and Lc increase. In the above-described manner, the inductances of the coils La to Lc are adjusted to be equal to each other.

If the differences between the inductances of the coils La to Lc are not in a desired range although the above-described adjustment is carried out, the adjustment is repeated. In this way, the inductances of the coils La, Lb, and Lc can be made equal to each other. Thus, the tri-filar type common mode choke coil 50 exhibiting a low inductance (impedance) for a normal mode signal can be produced.

Other Preferred Embodiments

The present invention is not restricted to the above-described preferred embodiments. Modifications and variations of the present invention are possible without departing from the sprit and the scope of the present invention. The laminate-type ceramic electronic component may be a laminated transducer or other suitable component, in addition to the laminated common mode choke coil. Moreover, the present invention may be applied to a laminate-type ceramic electronic component having at least four coils. The first and second preferred embodiments describe the laminate-type common mode choke coils that are individually produced products. In the case of the mass production of the laminate-type common mode choke coils, a mother laminated block including a plurality of laminate-type ceramic electronic components is formed.

In the above-described preferred embodiments, the winding directions of the adjacent coils are preferably opposite to each other. However, the winding directions of adjacent coils may be the same.

The present invention is not restricted to a technique by which ceramic sheets having coil conductors formed thereon are laminated, and are integrally fired for production of the laminate-type ceramic electronic component. The ceramic sheets that have been fired previously may be used. The laminate-type ceramic electronic component may be produced by the following technique. That is, a ceramic layer is formed with a paste ceramic material by printing or other suitable process. A paste conductive material is coated onto the surface of the ceramic layer to form a coil conductor.

Then, a paste ceramic material is coated so as to cover the coil conductor, so that a ceramic layer including the coil conductor is formed. Thereafter, the coating is repeated in a similar manner, while necessary portions of the coil conductors are electrically connected. Thus, a ceramic electronic component having a lamination structure is produced.

The present invention is not limited to each of the above-described preferred embodiments, and various modifications are possible within the range described in the claims. An embodiment obtained by appropriately combining technical means disclosed in each of the different preferred embodiments is included in the technical scope of the present invention.

What is claimed is:

1. A laminate-type ceramic electronic component comprising:

a laminate body including a plurality of ceramic layers and a plurality of coil conductors that are laminated to each other in a lamination direction; and first and second coils including the plurality of coil conductors;

the first and second coils being arranged in the lamination direction of the ceramic layers while the axial directions of the first and second coils are substantially coincident with the lamination direction of the ceramic layers:

a distance T1 between the first coil and a surface of the outer layer of the laminate body nearer to the first coil and a distance T2 between the second coil and a surface of the outer layer of the laminate body nearer to the second coil in the lamination direction being different from each other.

2. A laminate-type ceramic electronic component according to claim 1, wherein a number of turns of the second coil is larger than a number of turns of the first coil, and the distance T1 is greater than the distance T2.

3. A laminate-type ceramic electronic component according to claim 1, wherein a number of turns of the first coil and a number of turns of the second coil are set so that the inductance of the first coil and the inductance of the second coil are substantially equal to each other.

4. A laminate-type ceramic electronic component according to claim 1, wherein the sizes of the first coil and that of the second coil are substantially equal to each other.

5. A laminate-type ceramic electronic component according to claim 1, wherein the laminate-type ceramic electronic component is one of a common mode choke coil and a transducer.

6. A laminate-type ceramic electronic component according to claim 1, wherein winding directions of the first and second coils are opposite to each other.

7. A laminate-type ceramic electronic component according to claim 1, wherein winding directions of the first and second coils are the same as each other.

8. A laminate-type ceramic electronic component according to claim 1, wherein a number of turns of the first coil is different from a number of turns of the second coil.

9. A laminate-type ceramic electronic component according to claim 8, wherein a difference between the numbers of turns of the first and second coils is in a range of not less than 0 to not more than about 1.0.

10. A laminate-type ceramic electronic component according to claim 1, wherein a thickness of an outer layer on a first coil side and that of an outer layer on a second coil side are different from each other.

11. A laminate-type ceramic electronic component according to claim 10, wherein the outer layer on the first coil side defines a magnetic path for a magnetic flux generated mainly by the first coil and the outer layer on the second coil side defines a magnetic path for a magnetic flux generated mainly by the second coil.

* * * * *